US005957606A

United States Patent [19]

Jafarmadar

[11] Patent Number: 5,957,606

[45] Date of Patent: Sep. 28, 1999

[54] APPLICATOR APPARATUS FOR DISPENSING LIQUID GROUT SEALANT

[76] Inventor: Hossein H. Jafarmadar, 75 Gulfstream Rd., Dania, Fla. 33009

[21] Appl. No.: 08/984,496

[22] Filed: Dec. 3, 1997

[51] Int. Cl.[6] ..... A46B 11/00

[52] U.S. Cl. ..... 401/140; 401/137; 401/139

[58] Field of Search ..... 401/140, 137, 401/139, 289, 196

[56] References Cited

U.S. PATENT DOCUMENTS

| | | | |
|---|---|---|---|
| 1,122,079 | 12/1914 | Cunneen | 401/140 |
| 2,008,381 | 7/1935 | Beeg | 401/139 |
| 3,210,794 | 10/1965 | Vosbikian | 401/140 |
| 4,802,782 | 2/1989 | Scalf | 401/140 |
| 5,316,401 | 5/1994 | Sears | 401/137 |
| 5,364,198 | 11/1994 | Skenderi | 401/140 |

FOREIGN PATENT DOCUMENTS

| | | | |
|---|---|---|---|
| WO86/05376 | 9/1986 | WIPO | 401/140 |

*Primary Examiner*—David J. Walczak
*Attorney, Agent, or Firm*—Malin, Haley, DiMaggio & Crosby, PA

[57] ABSTRACT

An applicator apparatus for dispensing liquid grout sealant within a grout filled groove formed between adjacent ceramic and clay floor and wall tiles. The apparatus includes a liquid container mounted on a handle and containing liquid grout sealant, a manual flow control valve, and a liquid dispensing head, all in fluid communication. The liquid dispensing head is flexibly connected to the handle and includes a liquid outlet for dispensing liquid grout sealant therefrom. A brush or roller is removably connected to the liquid dispensing head for uniformly spreading liquid grout sealant over grout within the groove. In a first embodiment, the container, control valve and liquid dispensing head are mounted on an elongated handle thereby providing a compact apparatus for dispensing liquid grout sealant to floors, counter tops, and walls. An alternate embodiment further includes a wheeled structure, having an alignment site disposed thereon, so the user is able to guide the device along a groove by rolling the apparatus over the underlying floor tile during the application process. The apparatus may further include at least one squeegee connected to the trailing end of liquid dispensing head for automatically wiping an excess sealant from the surfaces of the tile as the apparatus is moved forward along a grout filled groove.

14 Claims, 5 Drawing Sheets

APPLICATOR APPARATUS FOR DISPENSING LIQUID GROUT SEALANT

BACKGROUND OF THE INVENTION

1. Field of the Invention

The present invention relates to applicator devices for dispensing liquid material, and more particularly to an applicator apparatus for dispensing liquid grout coatings, such as grout sealant, to grout joints in floor tile installations.

2. Description of the Background Art

The use of floor tile as a floor covering is well known. In recent years the use of ceramic and clay floor tiles has substantially increased. A typical floor tile installation consists of a plurality of tiles bonded to an underlying subfloor by bonding material, including mortar and grout.

In the typical installation a layer of mortar is applied over the subfloor to be tiled. Next, floor tiles are placed on top of the mortar layer. The tiles are typically spaced relative to one another such that a gap exists between adjacent tiles. Accordingly, the space between the tiles defines the size of the gap, and gap sizes vary depending on the type and style of tile used and the desired spacing of the tiles. Typical gap sizes range from ¼" to ¾". Once the mortar sets, thereby fixing the tiles in place, the gaps are filled with grout. Portland cement is the base for most grout and additives are used to produce grout having specific qualities such as color, mildew resistance, hardness, etc. Furthermore, alternate grout substances, such as epoxies and silicone, are sometimes used. The grout substantially fills the gaps and results in the formation of a network of grooves between the tile.

Most grout compounds, however, are porus and thus easily damaged and stained. Therefore, it is common to apply a coat of clear liquid sealant in the grooves between the tiles to protect the underlying grout. In other applications a colored grout sealant may be used. The most common method of applying liquid grout sealant involves a worker dispensing a quantity of liquid grout sealant from a hand held container, such as a squeeze bottle, and brushing the sealant, with a hand held brush, to completely coat the grout groove, thereby requiring the worker to work on his hands and knees. The prior art method of applying grout sealant is time consuming, laborious, and difficult. As a result, the background art reveals attempts to improve upon the grout sealant application methods and devices of the background art.

U.S. Pat. No. 5,498,103, issued to Bauer, III, discloses an applicator apparatus for dispensing a sealant. The device disclosed by Bauer includes a dispensing head having a convex bottom surface which rides on the edges of the tile forming the groove and which includes a sealant dispensing passage having a sealant outlet at the bottom thereof for dispensing sealant into the groove.

The Bauer device, however, includes a number of disadvantages which prevent such a device from gaining wide spread acceptance. For example, since the Bauer device rides along the edges of the tile it is quite possible for the tile to be scratched. Furthermore, the Bauer device merely dispenses liquid sealant through a passage and does not thereafter insure that the dispensed sealant will achieve a uniform coating. Accordingly, there still exists a need for an applicator apparatus for dispensing liquid grout coatings, such as grout sealant, by applying a uniform protective coating over a grout joint.

SUMMARY OF THE INVENTION

An applicator apparatus for dispensing liquid grout coatings, such as grout sealant, over grout within grooves formed between adjacent floor tiles. An applicator apparatus according to the present invention includes a handle, a liquid container containing a quantity of suitable liquid grout sealant, connected to the handle, having an outlet communicating with a flow control valve, and a liquid dispensing head. In a preferred embodiment, the liquid container includes an air vent for allowing an even flow of liquid sealant from the container, and the flow control valve is capable of controlling the rate of flow of liquid being dispensed by the apparatus. Furthermore, the liquid dispensing head includes a liquid outlet nozzle having in one embodiment a plurality of brush-like bristles disposed in surrounding relation therewith, and in other embodiments a removable brush or roller connected thereto. The liquid outlet nozzle and brush/roller configuration provides for a smooth, uniform and even application of grout sealant. Preferably, at least the brush portion of the liquid dispensing head is removable and replaceable such that various brush sizes may be installed depending on the spacing of the tiles and the groove width.

In a first embodiment, the container, control valve and liquid dispensing head are mounted on an elongated handle thereby providing a compact apparatus for dispensing liquid grout sealant to floors, counter tops, and walls. The liquid dispensing head may be flexibly connected to the handle.

In a second embodiment, the container, control valve, liquid dispensing head, and handle are mounted on a wheeled structure, having an alignment site disposed thereon, so the user is able to guide the device along a groove by rolling the apparatus over the underlying floor tile during the application process. The second embodiment, may further include a pair of squeegees, adjustably mounted to the trailing end of the wheeled structure, disposed on either side of dispensing head, for automatically wiping an excess sealant from the surfaces of the tile as the device rolls forward. Therefore, the present invention provides an apparatus for quickly and easily dispensing liquid grout sealant within the narrow confines of any sized groove defined between floor tiles in a manner that results in a smooth and uniform layer of grout sealant.

Accordingly, it is an object of the present invention to provide an improved applicator apparatus for dispensing liquid grout sealant.

Yet another object of the present invention is to provide an improved applicator apparatus for dispensing liquid grout sealant within floor tile grooves of any size.

Still another object of the present invention is to provide a hand-held applicator apparatus for dispensing liquid grout sealant within tile grooves on walls and counter tops, in addition to floors.

A further object of the present invention is to provide an applicator apparatus for dispensing liquid grout sealant that enables the user to control the grout sealant flow rate.

Yet another object of the present invention is to provide an applicator apparatus for dispensing liquid grout sealer including a pair of opposing squeegees for removing excess grout sealant from the tile surfaces.

In accordance with these and other objects which will become apparent hereinafter, the instant invention will now be described with particular reference to the accompanying drawings.

DESCRIPTION OF THE PREFERRED EMBODIMENTS

Figure 1:
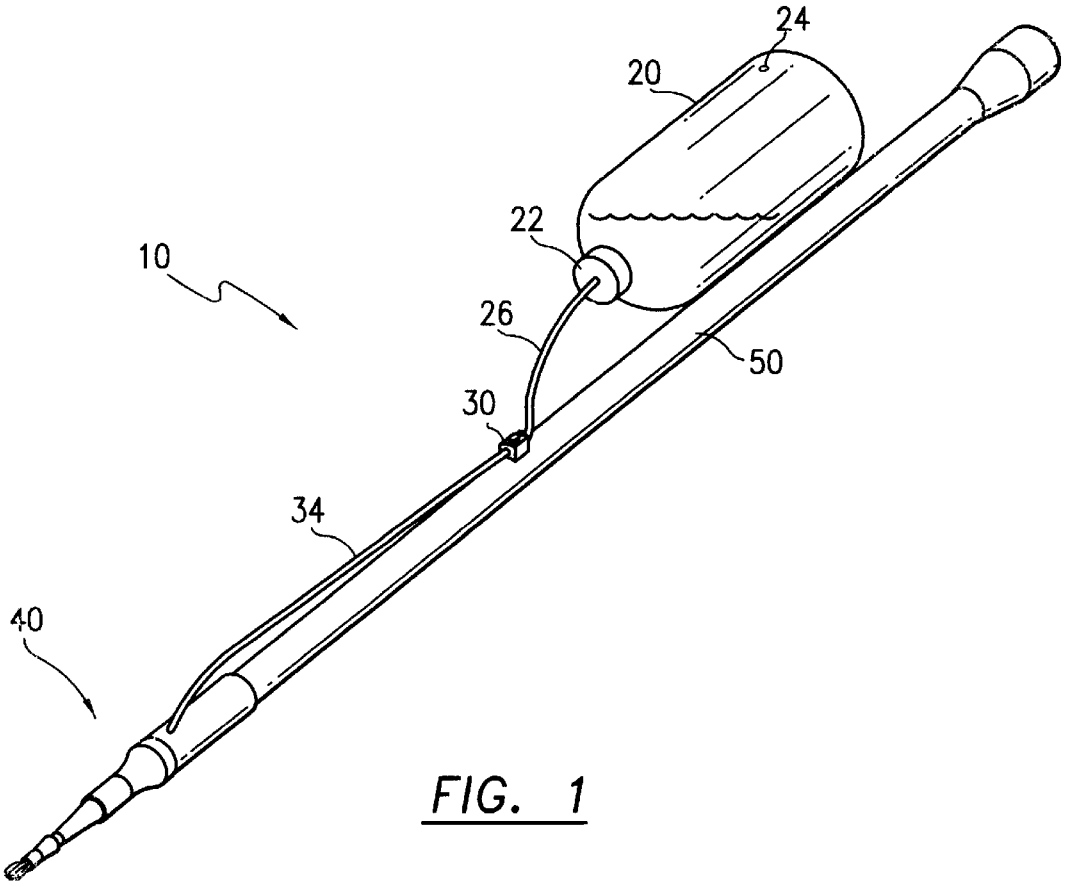
FIG. 1 is a front perspective view of a grout sealant dispensing apparatus according to the present invention.

FIG. 1 depicts an applicator apparatus, generally referenced as 10, for dispensing liquid grout sealant within the confines of grout filled grooves formed between adjacent floor tiles. The apparatus includes liquid container 20, containing a quantity of suitable liquid grout sealant, a flow control valve 30 and a liquid dispensing head 40.

In a preferred embodiment, liquid container 20 comprises a lightweight fillable container. Container 20 includes a liquid outlet 22 and an air vent 24 which cooperate to allow an even flow of liquid sealant from the container during the sealant dispensing process. Container 20 is fluidly connected to liquid flow control valve 30 by tubing 26. Control valve 30 comprises a manually actuated control valve and includes on, off, and intermediate flow positions for enabling the user to regulate the flow of liquid from container 20. Control valve 30 is preferably located proximate container liquid outlet 22 or in any suitable location easily reached by the user. In applications where it is necessary to apply sealant to elevated tile grooves, such as those found on walls, it may be desirable for container 20 to be pressurized so as to permit liquid sealant to flow against gravity when the liquid dispensing head 40 is required to be elevated with respect to container 20.

Control valve 30 is in fluid communication with a liquid dispensing head, generally referenced as 40, via tubing 34. Liquid dispensing head 40 defines a liquid dispensing outlet 42, and a plurality of brush-like bristles 44 disposed in surrounding relation therewith. Outlet 42 functions to dispense liquid from container 20, which dispensed liquid is uniformly spread within the groove by bristles 44 by movement of the device during operation. The liquid outlet and brush bristle configuration provides for a smooth, uniform and even application of grout sealant. Preferably, at least the brush portion of the liquid dispensing head is removable and replaceable such that various brush sizes may be installed depending on the spacing of the tiles and the groove width.

In a first embodiment, container 20, control valve 30, and liquid dispensing head 40 are mounted on an elongated handle 50 thereby providing a compact apparatus for dispensing liquid grout sealant to floors, counter tops, and walls. Accordingly, the present invention provides the user with an effective apparatus for applying liquid grout sealant within grout filled grooves existing between a plurality of tiles. To use the device, the user fills container 20 with a suitable liquid grout sealant, positions tip 40, and particularly bristles 44, substantially adjacent to a grout filled groove, actuates flow control valve 30 to an open position wherein liquid grout sealant is allowed to flow from container 20 to tip 40, via tubing 26 and 34, such that the liquid grout exits outlet 42 and is uniformly spread over the grout within the groove by bristles 44 as the user moves the apparatus along the groove.

Figure 2:
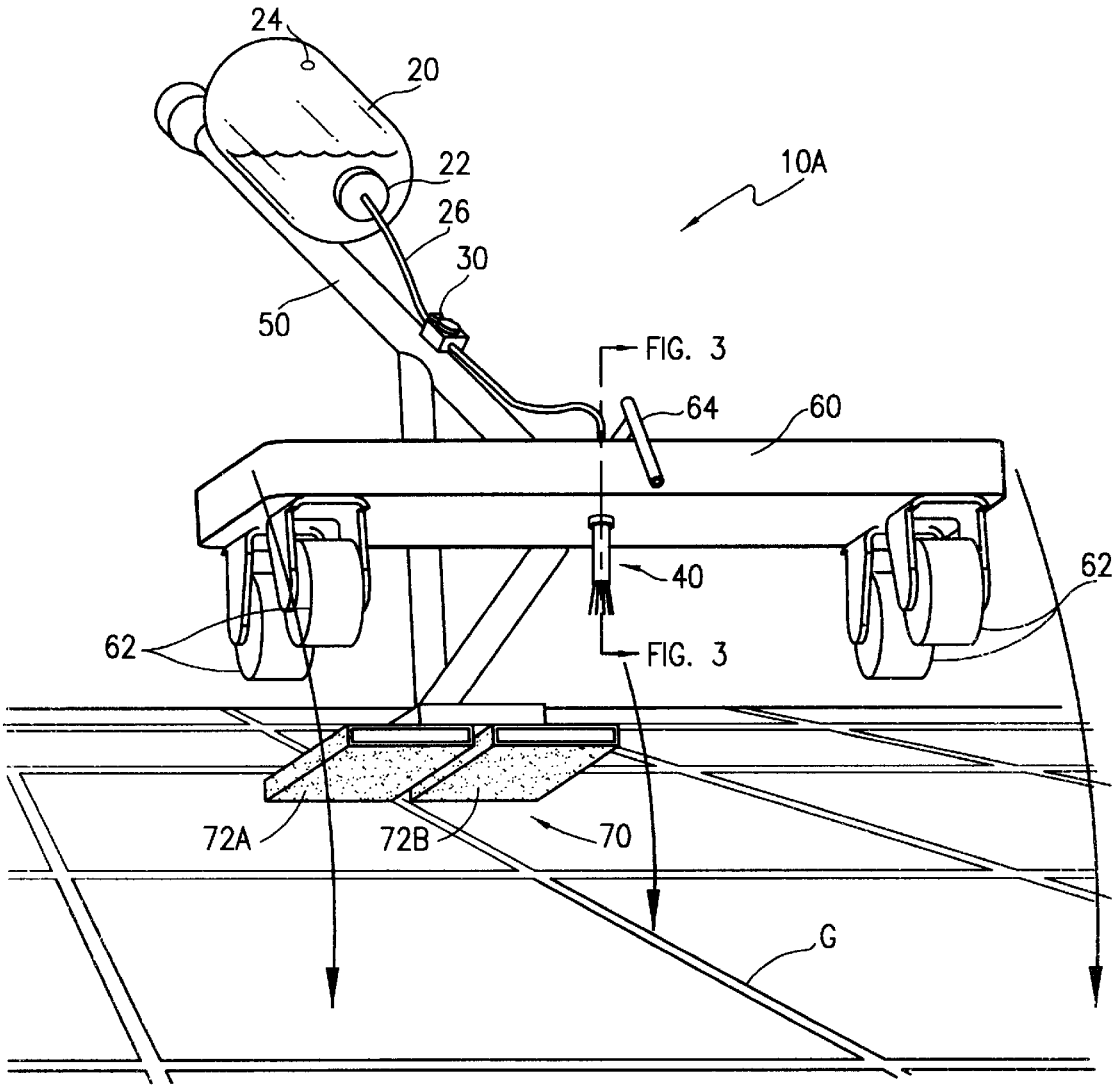
FIG. 2 is a front perspective view of a wheeled embodiment of a grout dispensing apparatus according to the present invention.
Figure 3:
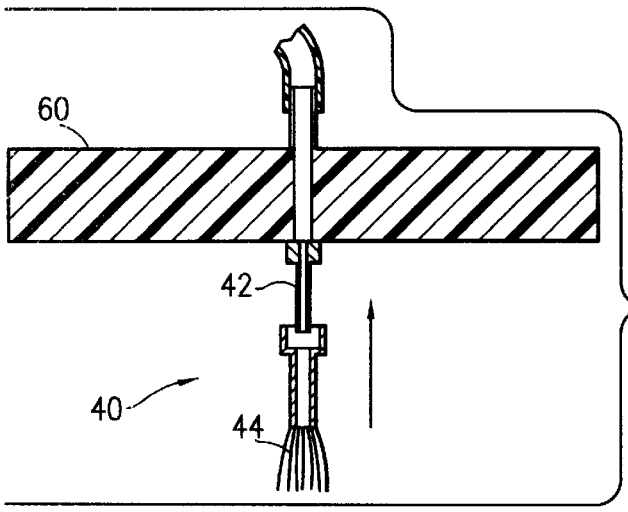
FIG. 3 is a fragmentary sectional view of the liquid dispensing head of the present invention along line 3—3 in FIG. 2.

FIG. 2 depicts an alternate embodiment, generally referenced as 10A. The alternate embodiment apparatus includes container 20, control valve 30, liquid dispensing head 40, and handle 50, all of which are mounted on a wheeled assembly including a structure 60, having a plurality of wheels 62 connected thereto and an alignment sight 64 disposed thereon, so the user is able to guide the device along a groove, identified as "G", by rolling the apparatus over the underlying floor tile during the application process. Sight 64 provides a visual alignment device whereby a user is able to maintain the liquid dispensing head 40 within a tile groove by visually maintaining the sight 64 directly over, or in alignment with, the groove while moving the apparatus while applying sealant. Wheels 62 are preferably formed from a non-scratch/non-marking material, such as plastic, and function to guide the device over the tile surfaces. Alignment site 64 is preferably centrally disposed on the leading end of the apparatus 10A and functions as a visual sight to assist the user in guiding the apparatus along the groove so that the liquid dispensing head remains within the confines of the groove.

The alternate embodiment 10A, may further include a squeegee assembly, generally referenced as 70, including a pair of squeegees 72A and 72B, adjustably mounted to the trailing end of structure 60. In the preferred embodiment, squeegees 72A and 72B are disposed in spaced relation on either side of a centerline aligned with dispensing head 40, for automatically wiping an excess sealant from the surfaces of the tile as the device rolls forward. Furthermore, squeegees 72A and 72B are preferably adjustable and may be moved to a desirable spacing depending upon the size of the gap formed from the tile spacing. Squeegees 72A and 72B, are preferably adjustable to accommodate tile spacing of up to 1-inch thereby allowing the user to precisely space the squeegees for removing excess sealant that may find its way onto the surfaces of the tile. As is apparent, the present invention provides an apparatus for quickly and easily dispensing liquid grout sealant within the narrow confines of any sized groove defined between floor tiles in a manner that results in a smooth and uniform layer of grout sealant.

Figure 4:
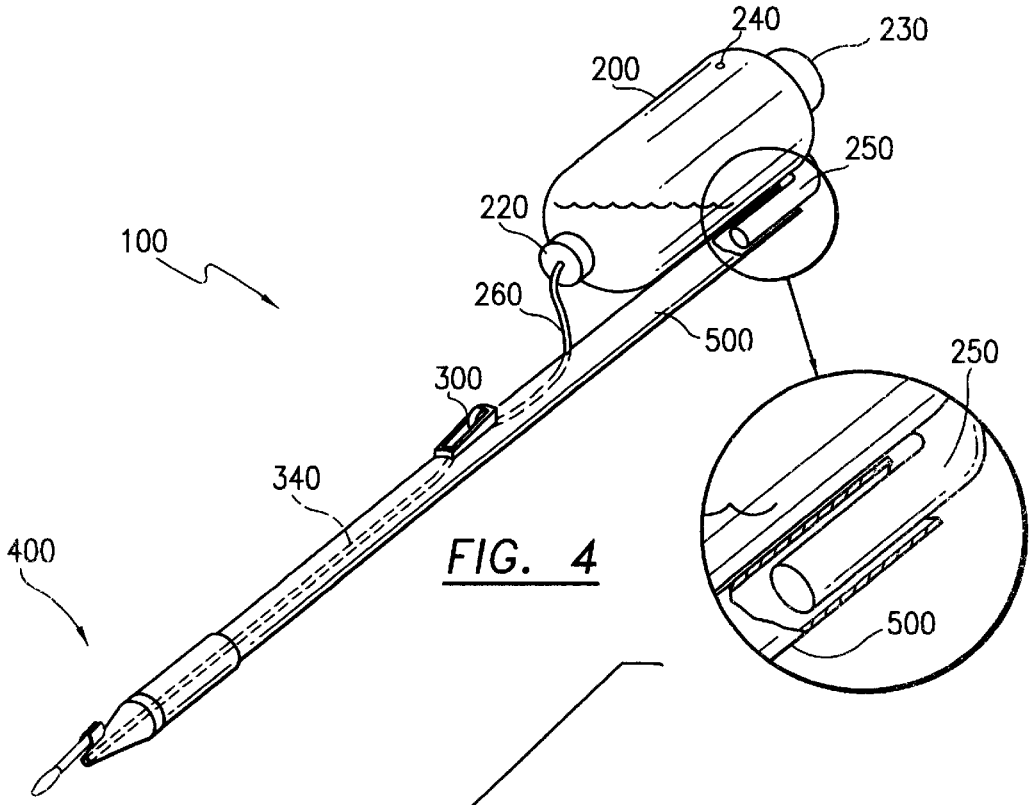
FIG. 4 is a front perspective view of an alternate embodiment apparatus according to the present invention.
Figure 5:
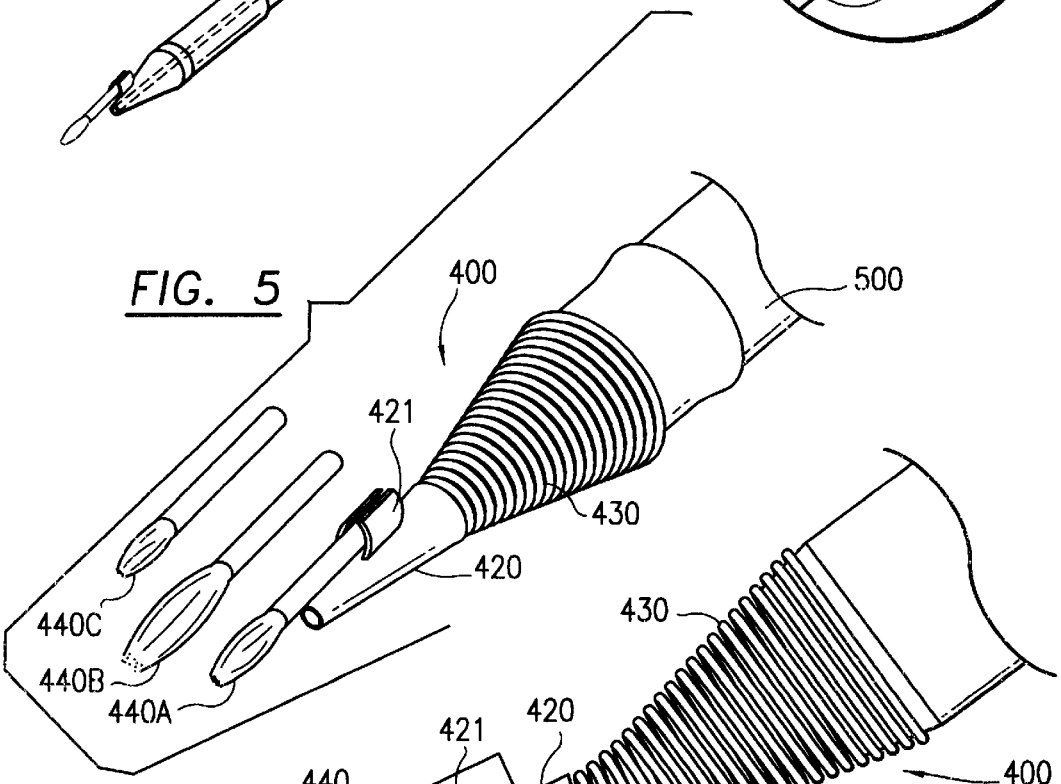
FIG. 5 is front perspective detail of an alternate liquid dispensing head shown in FIG. 4.
Figure 6:
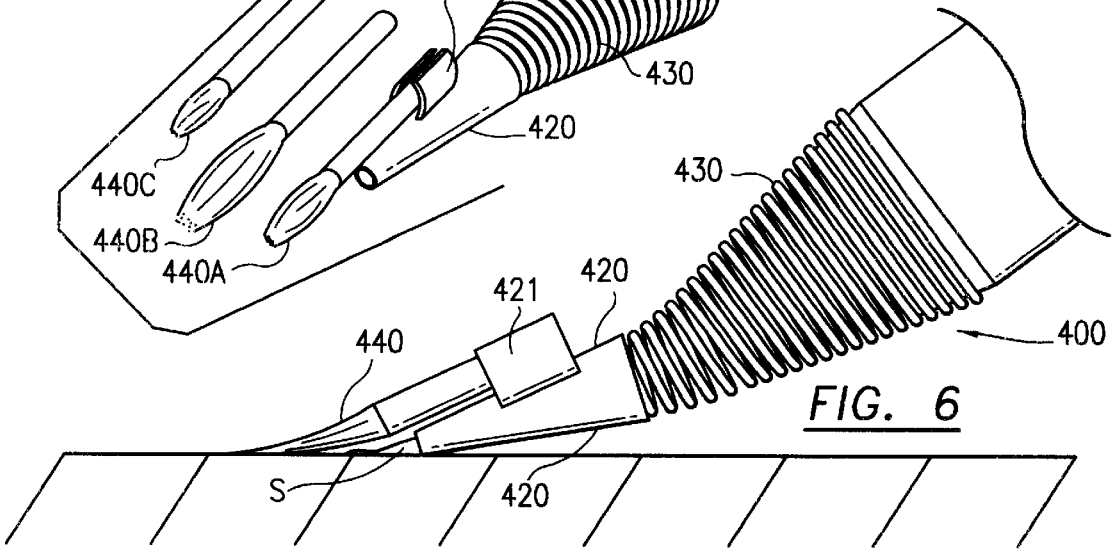
FIG. 6 is a side detail view of the alternate liquid dispensing head shown in FIGS. 4 and 5.

FIGS. 4–6 depict another alternate embodiment device according to the present invention. FIG. 4 depicts an alternate embodiment applicator apparatus, generally referenced as 100, for dispensing liquid grout sealant within the confines of grout filled grooves formed between adjacent floor, wall and counter top tiles. The apparatus includes liquid container 200, containing a quantity of suitable liquid grout sealant, a flow control valve 300, a liquid dispensing head 400, and an elongated handle 500.

In this alternate embodiment, liquid container 200 comprises a lightweight fillable container. Container 200 includes a liquid outlet 220 and an air vent 240 which cooperate to allow an even flow of liquid sealant from the container during the sealant dispensing process. As best depicted in FIG. 4, container 200 further includes a projecting mounting member 250, which is suitable sized for mating engagement with an aperture defined at the end of handle 500. Furthermore, container 200 includes a removable cap 230 to facilitate the filling of container 200 with liquid grout sealant. It is also contemplated that vent 240 may be incorporated into removable cap 230 thereby resulting in a vented cap. Container 200 is fluidly connected to liquid flow control valve 300 by tubing 260. Control valve 300 comprises a manually actuated control valve and includes on, off, and intermediate flow positions for enabling the user to regulate the flow of liquid from container 200. In the preferred embodiment, control valve 300 comprises a valve of the type known for use in the medical profession to control the gravity induced flow of intravenous fluids, however, any suitable control valve is considered within the scope of the present invention. Control valve 300 is preferably located proximate container liquid outlet 220 in a suitable location that may be easily reached by the user, and may be recessed, along with tubing 260 and 340, within handle 500. In applications where it is necessary to apply sealant to elevated tile grooves, such as those found on walls, it may be desirable for container 200 to be pressurized so as to permit liquid sealant to flow against gravity when the liquid dispensing head 400 is required to be elevated with respect to container 200. It is noted that use of a pressurized container requires elimination of vent 240.

Control valve 300 is in fluid communication with an alternate embodiment liquid dispensing head, generally referenced as 400, via tubing 340. The liquid dispensing head 400 includes a liquid dispensing outlet 420 having a fastening clip 421, for removably securing a suitably sized brush 440A, 440B or 440C. Brushes 440A–C are suitably sized for use with correspondingly sized grout grooves, and are preferably sized from ⅛" to ¾". As best depicted in FIGS. 5 and 6, liquid dispensing outlet 420 is connected to handle 500 by a flexible connector 430. In a preferred embodiment flexible connector 430 comprises a helical spring. As seen in FIG. 6, flexible connector 430 provides resilient flexibility to liquid dispensing head 400, and particularly the portion thereof including liquid dispensing outlet 420, to allow the dispensing outlet to accurately ride along an undulating grout joint while dispensing grout sealant "S," from container 200. Brush 440A is removably connected by clip 421 proximate liquid dispensing outlet 420, and suitably positioned while the device is in use to a trailing position with respect to outlet 420 for evenly spreading the grout sealant "S" over the entire grout joint. The flexible liquid outlet 420 and trailing brush provides for a smooth, uniform, and even application of grout sealant. Preferably, at least the brush 440 portion of the liquid dispensing head 400 is removable and replaceable such that various brush sizes may be installed depending on the spacing of the tiles and the groove width. Likewise, outlet 420 may be replaceable on the liquid dispensing head 400, such that a suitably sized outlet may be matched to a specific grout joint size.

Figure 7:
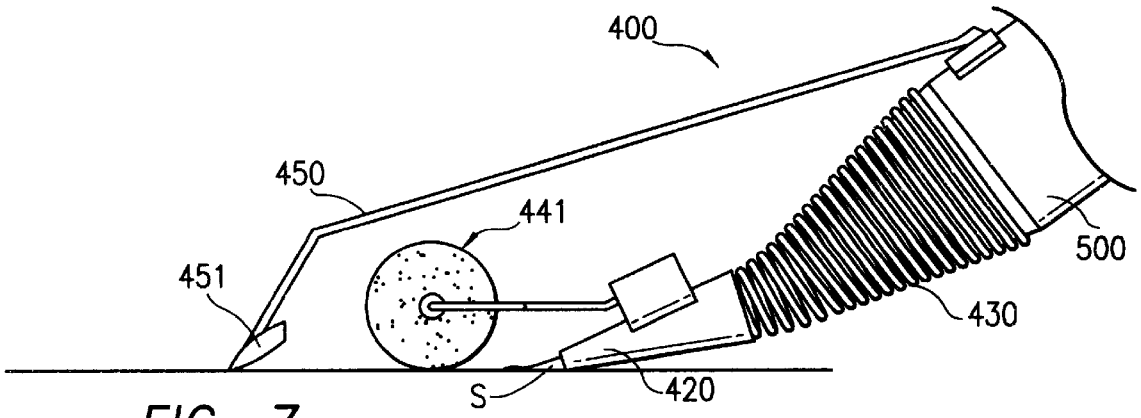
FIG. 7 is a side detail view of another alternate liquid dispensing head according to the present invention.
Figure 8:
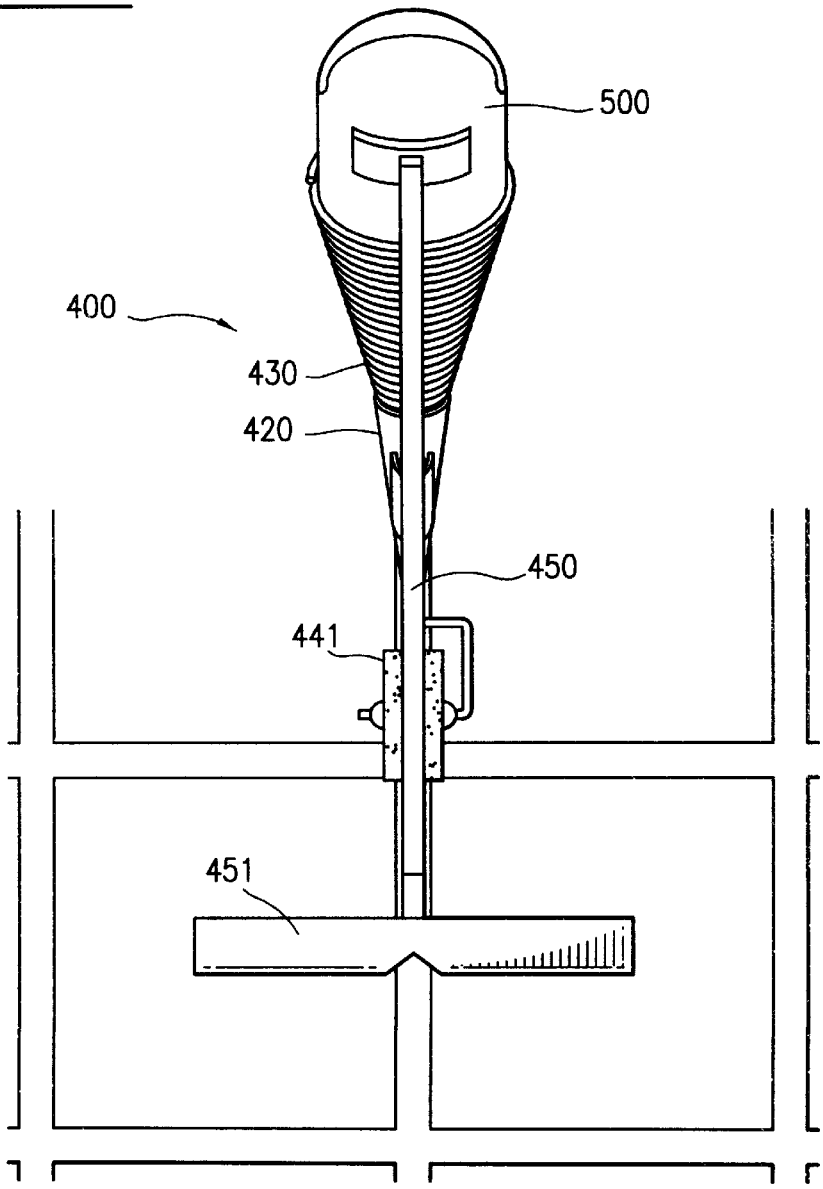
FIG. 8 is a top plan view of the alternate liquid dispensing head shown in FIG. 7, illustrating use in dispensing liquid sealant within a grout filled floor tile joint.
Figure 9:
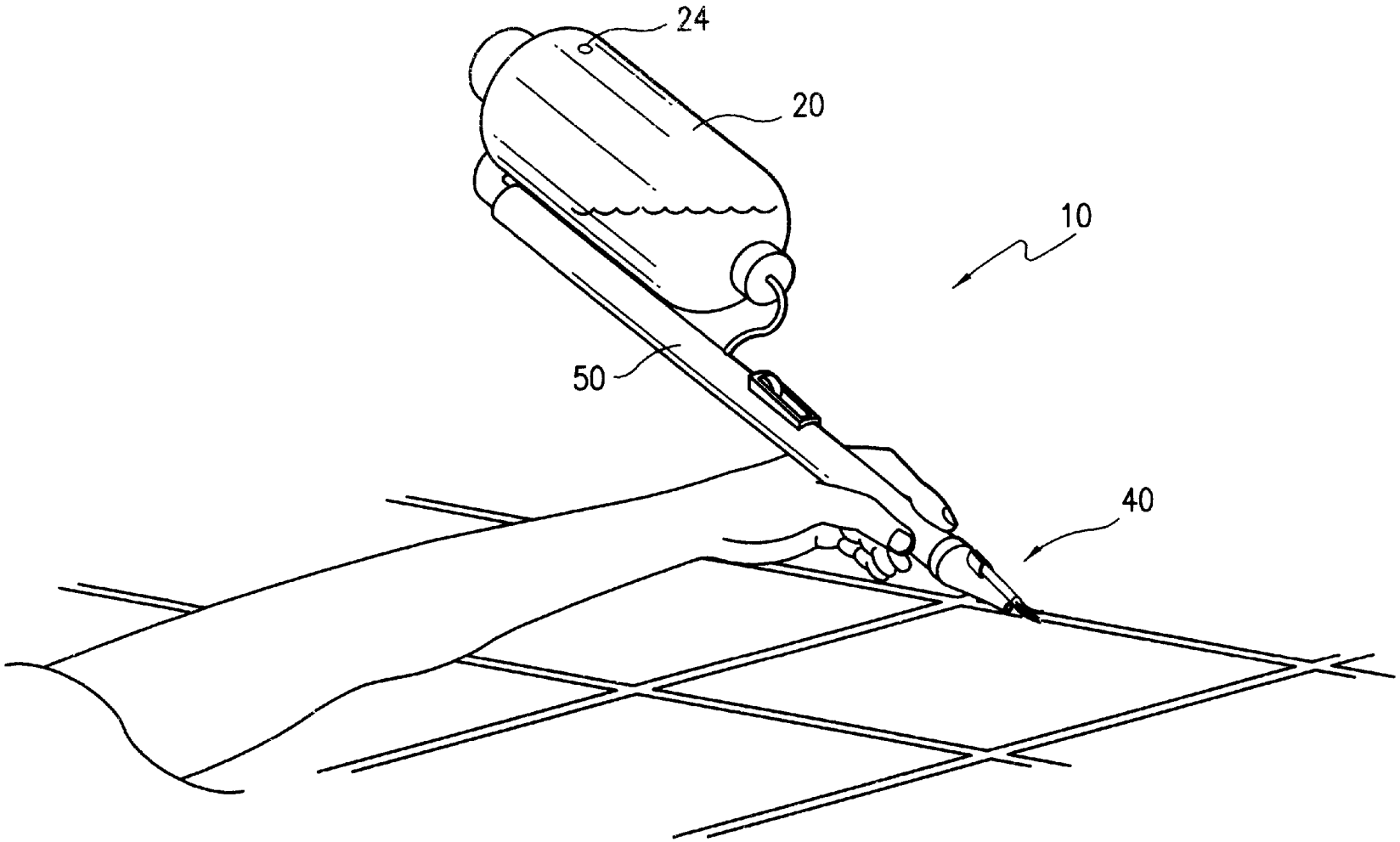
FIG. 9 is a perspective view illustrating use of a hand-held sized embodiment of an applicator apparatus according to the present invention.

In yet another alternate embodiment depicted in FIGS. 7 and 8, clip 421 may be utilized to removably secure a suitably sized roller, generally referenced as 441. Roller 441 comprises a rotatable spreading device, such as a paint roller, for spreading liquid grout sealant within a grout joint, and is used in lieu of brush 440. As with brushes 440A–C, roller 441 is preferably available in a variety of sizes and a suitable sized roller is selected and attached for use with correspondingly sized grout grooves, ranging from ⅛" to ¾". The embodiment depicted in FIGS. 7 and 8 further includes a squeegee 450 connected thereto. Squeegee 450 includes a blade 451 defining a notch. Squeegee 450 is preferably connected to handle 500, but may be connected to tip 400, and is operationally disposed in a trailing position with respect to outlet 420 and roller 441, such that the notch defined by blade 451 is aligned the grout groove as seen in FIG. 8, for wiping excess grout sealant "S" from the surfaces of adjacent tiles. FIG. 8 depicts a top plan view of the embodiment depicted in FIG. 7, operationally positioned along a grout joint formed by tiles.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An applicator apparatus for dispensing liquid sealant within a narrow grout filled groove formed between tiles, said apparatus comprising:

an elongated handle;

a liquid container connected to said handle;

a manual flow control valve fluidly communicating with said container;

a liquid dispensing head connected to said handle, said head having an outlet with a narrow opening of a predetermined size to release fluid in a narrow stream sized to cover tile grout between one half inch and three quarter inches wide fluidly communicating with said flow control valve;

said liquid dispensing head includes a brush connected thereto for uniformly spreading liquid grout sealant dispensed from said outlet; and a squeegee connected to said handle.

2. An applicator apparatus according to claim 1, wherein said brush is removable.

3. An applicator apparatus according to claim 1, wherein said liquid dispensing head is removable.

4. An applicator apparatus according to claim 1, wherein said liquid dispensing head includes a roller for spreading fluid.

5. An applicator apparatus according to claim 4, wherein said squeegee has a blade defining a notch.

6. An applicator apparatus according to claim 1, further including a plurality of wheels connected to said handle.

7. An applicator apparatus according to claim 6, further including means for visually aligning said liquid dispensing head within a groove.

8. An applicator apparatus for manually dispensing liquid grout sealant within a narrow grout filled groove formed between tiles, said apparatus comprising:

an elongated handle;

a liquid container connected to said handle;

a manually actuated flow control valve fluidly communicating with said container, said control valve having an open position wherein liquid is allowed to flow through said valve, and a closed position wherein liquid is not allowed to flow through said valve;

a liquid dispensing head having an outlet with a narrow opening of a predetermined size to release fluid in a narrow stream sized to cover the tile grout between one half inch and three quarters inches wide fluidly communicating with said flow control valve, whereby liquid from said container is dispensed from said outlet when said flow control valve is in an open position;

said liquid dispensing head is connected to said handle by a flexible connector, wherein said flexible connector comprises a helical spring; and means for uniformly spreading liquid dispensed from said outlet opening in a narrow path on said tile grout.

9. An applicator apparatus according to claim 8, wherein said liquid dispensing head is removable.

10. An applicator apparatus according to claim 8, wherein said means for spreading comprises a brush.

11. An applicator apparatus according to claim 8, wherein said means for spreading comprises a roller.

12. An applicator apparatus for dispensing liquid grout sealant within narrow grout filled grooves formed between ceramic and clay floor and wall tiles to eliminate sealant from collecting on said tile surfaces, said apparatus comprising:

an elongated handle;

a liquid container connected to said handle, said container having an air vent;

a manually actuated flow control valve fluidly communicating with said container, said control valve having an open position wherein liquid is allowed to flow through said valve to control the volume of fluid to a desired amount, and a closed position wherein liquid is not allowed to flow through said valve;

a liquid dispensing head flexibly connected to said handle, said liquid dispensing head having an outlet having a narrow opening to release said liquid in a narrow stream sized in diameter only to cover tile grout between one half inch and three quarters inches wide fluidly communicating with said flow control valve, whereby liquid from said container may be selectively dispensed from said outlet opening when said flow control valve is manually actuated to said open position; and a liquid spreader removably connected to said liquid dispensing head for uniformly spreading liquid dispensed from said outlet opening within grooves formed between tiles to control the width of said dispensed fluid path to prevent excess sealant from contacting said tile surface.

13. An applicator apparatus according to claim 12, further including a squeegee connected to said handle.

14. An applicator apparatus according to claim 12, further including at least one wheel connected to said handle.

* * * * *